US010612873B1

(12) United States Patent
Witecha

(10) Patent No.: US 10,612,873 B1
(45) **Date of Patent: *Apr. 7, 2020**

(54) APPARATUS AND METHOD FOR LOADING PISTOL MAGAZINES

(71) Applicant: Kirk Joseph Witecha, Delray Beach, FL (US)

(72) Inventor: Kirk Joseph Witecha, Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/171,546

(22) Filed: Oct. 26, 2018

Related U.S. Application Data

(63) Continuation of application No. 15/641,793, filed on Jul. 5, 2017, now Pat. No. 10,139,176.

(60) Provisional application No. 62/358,750, filed on Jul. 6, 2016.

(51) Int. Cl.
*F41A 9/84* (2006.01)
*F41A 9/83* (2006.01)

(52) U.S. Cl.
CPC . *F41A 9/84* (2013.01); *F41A 9/83* (2013.01)

(58) Field of Classification Search
CPC ..... F41A 9/83; F41A 9/84
See application file for complete search history.

(56) References Cited

U.S. PATENT DOCUMENTS 4,392,321 A 7/1983 Bosworth
7,059,077 B2 * 6/2006 Tal ..... F41A 9/83 42/88
8,915,007 B1 * 12/2014 Williams ..... F41A 9/83 42/87
9,207,038 B2 * 12/2015 Gilley ..... F41A 9/83
9,618,286 B1 * 4/2017 Plate ..... F41A 9/83
9,689,633 B1 * 6/2017 Plate ..... F41A 9/83
10,139,176 B1 * 11/2018 Witecha ..... F41A 9/83
10,151,547 B1 * 12/2018 Plate ..... F41A 9/83
2003/0046854 A1 3/2003 Urchek
2004/0159035 A1 * 8/2004 Newman ..... F41A 9/83 42/87
2014/0033592 A1 * 2/2014 Fiorucci ..... F41A 9/83 42/87
2016/0025437 A1 1/2016 Slocum

* cited by examiner

*Primary Examiner* — Joshua T Semick

(74) *Attorney, Agent, or Firm* — Edell, Shapiro & Finnan, LLC

(57) ABSTRACT

An apparatus for loading cartridges into a pistol magazine comprises a main unit with a magazine holder having an opening configured to receive a pistol magazine with a first long axis and a tray having an elongate channel configured to arrange a stack of cartridges along a second long axis laterally offset from the first long axis. An angled wall extends across the elongate channel toward the opening at a non-zero angle relative to the second long axis. A sleeve covers the cartridges in the main unit, and a handle is movable relative to the main unit to cause the cartridges to be pushed into the magazine. Moving the handle is continued to cause each of the cartridges in succession to be tilted by the angled wall and loaded via the opening into the pistol magazine along the first long axis.

19 Claims, 15 Drawing Sheets

APPARATUS AND METHOD FOR LOADING PISTOL MAGAZINES

CROSS-REFERENCE TO RELATED APPLICATIONS

This application is a continuation of U.S. patent application Ser. No. 15/641,793, filed on Jul. 5, 2017, which claims priority to U.S. Provisional Patent Application No. 62/358,750, filed on Jul. 6, 2016, the contents of which are incorporated by reference herein in their entirety.

FIELD OF THE INVENTION

The present invention relates generally to the field of firearms and, more specifically, to technologies for loading cartridges into a removable magazine for a firearm such as a pistol.

DISCUSSION OF THE BACKGROUND ART

Modern semi-automatic firearms are often designed to be fed ammunition (e.g., rounds or cartridges) from a removable magazine. Typically, the magazine includes a tubular housing of generally rectangular cross-section capable of holding one or two columns of cartridges. A follower is mounted on a strong spring at the bottom of the housing to urge the cartridges upwardly toward the open end of the magazine so that a cartridge is always in position to be fed into the chamber after a round is discharged. A pair of lips or flanges at the open end of the magazine engage the cartridge casing to prevent the cartridges from moving vertically beyond the magazine, while allowing the uppermost cartridge to be fed laterally into the chamber of the firearm. Handgun or pistol magazines expose only a single round between both lips, the gap between which is too narrow to allow a cartridge to pass through, whereas magazines for rifles typically have lips that are spaced further apart to expose two rounds between the lips. The configuration of the lips at the open end of a pistol magazine, coupled with the strength of the spring, makes loading cartridges into a pistol magazine particularly difficult. The casing of each cartridge must be located forwardly of the lips and pressed downwardly against the uppermost cartridge in the magazine with great force, usually with one's fingers, until the casing clears the lips and can be slid laterally under the lips to properly seat the cartridge in the magazine. The process is repeated for each cartridge and can be painful and time consuming when loading large capacity magazines.

SUMMARY OF THE INVENTION

A first aspect of the invention is directed to an apparatus for loading cartridges into a pistol magazine. An apparatus according to an example embodiment of the invention comprises a main unit with a magazine holder for holding a magazine and a tray for holding cartridges. The apparatus may also include a wall that covers the cartridges in the tray, and a handle movable relative to the tray. The magazine holder is configured to receive a pistol magazine with a first long axis, and the tray includes an elongate channel configured to arrange a column of cartridges along a second long axis laterally offset from the first long axis. The tray further includes an angled wall extending across the elongate channel adjacent the magazine holder and oriented at a non-zero angle relative to the second long axis. The handle includes a pusher disposed inside the elongate channel so that, when the handle is moved in the direction of the magazine holder, the pusher forces cartridges in the tray against the angled wall and into the pistol magazine. The angled wall may be oriented at an angle of about 45° relative to the second long axis. The pusher may include an angled pusher surface oriented at an oblique angle relative to the second long axis. The angled pusher surface may be oriented at an angle of about 70° relative to the second long axis. The wall covering the tray may include a longitudinal slot, and the handle may include a grip connected to the pusher via a member slidably disposed in the longitudinal slot. The wall may be part of a sleeve configured to fit telescopically around the tray.

A second aspect of the invention is directed to a method of loading cartridges into a pistol magazine. A method according to an example embodiment of the invention comprises inserting a pistol magazine with a first long axis into a magazine holder, arranging a plurality of cartridges in an elongate channel of a tray coupled with the magazine holder such that the cartridges are stacked along a second long axis that is laterally offset from the first long axis, covering the cartridges in the tray with a wall, positioning a pusher on a side of the plurality of cartridges opposite the pistol magazine, and moving a handle connected to the pusher in a direction of the pistol magazine to cause the pusher to urge the plurality of cartridges toward an angled wall at an end of the elongate channel adjacent the magazine holder. Moving the handle may be continued to cause each of the cartridges in succession to be tilted using the angled wall and loaded into the pistol magazine along the first long axis. Positioning a pusher may include positioning a pusher with an angled pusher surface oriented at an oblique angle relative to the second long axis. Covering the cartridges in the tray may include covering the cartridges with a wall having a longitudinal slot formed therein, and moving the handle may include sliding a grip connected to the pusher via a member in the longitudinal slot. Covering the cartridges in the tray may also include covering the cartridges with a sleeve fitted telescopically over the tray.

Advantages of the present invention are best understood with reference to the attached drawings, in which like reference numerals denote like parts.

DETAILED DESCRIPTION OF EXAMPLE EMBODIMENTS

Figure 1:
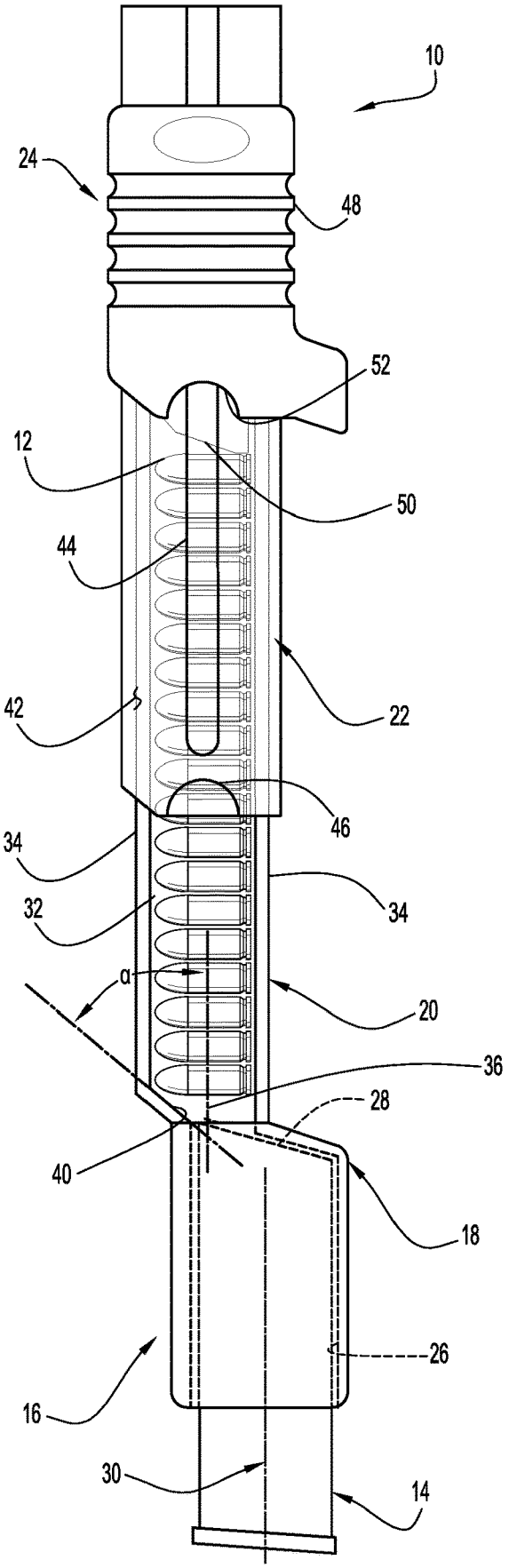
FIG. 1 is a side view of an example embodiment of an apparatus for loading a pistol magazine according to the present invention.
Figure 2:
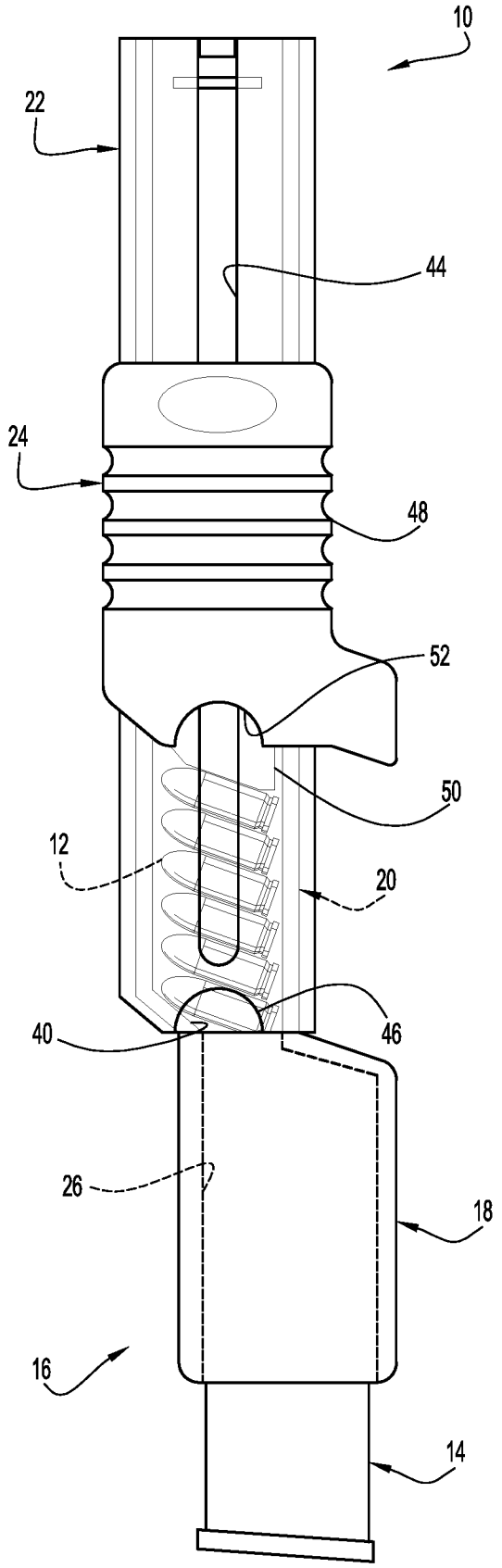
FIG. 2 is a side view of the apparatus of FIG. 1 in use.
Figure 3:
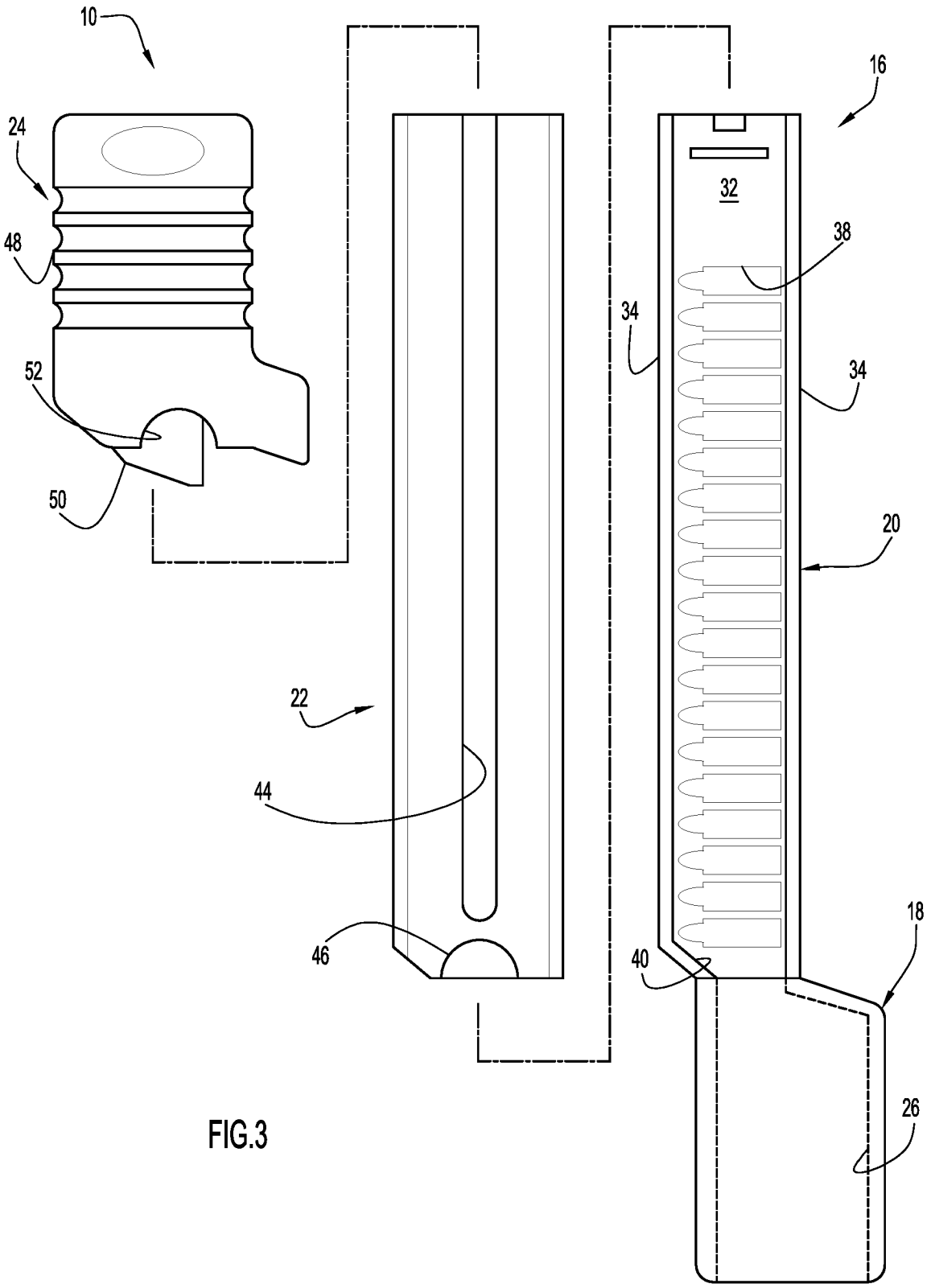
FIG. 3 is an exploded side view of the apparatus of FIG. 1.

An apparatus 10 for loading cartridges 12 into a pistol magazine 14 according to an example embodiment is shown in FIGS. 1-3. The apparatus 10 comprises a main unit 16 with a magazine holder 18 for holding a pistol magazine 14 and an elongate tray 20 for positioning a plurality of loose cartridges 12 in a column adjacent an open end of the pistol magazine, a sleeve 22 to help retain the cartridges in the tray during loading, and a handle 24 mounted on the sleeve and movable relative to the tray to push the cartridges into the open end of the pistol magazine in the magazine holder. FIG. 1 shows the handle 24 in a first position located above the column of cartridges 12 before a loading operation. The sleeve 22 is shown in a slightly retracted position in FIG. 1 to better illustrate features of the invention, but is normally positioned as shown in FIG. 2 during a loading operation to prevent cartridges from popping out of the tray before they reach the magazine. FIG. 2 shows the handle 24 in a second position linearly displaced from the first position in the direction of the magazine 14 during a loading operation in which the cartridges are pushed into the magazine. FIG. 3 is an exploded side view of the apparatus 10 showing details of the main unit 16, the sleeve 22, and the handle 24.

Figure 4:
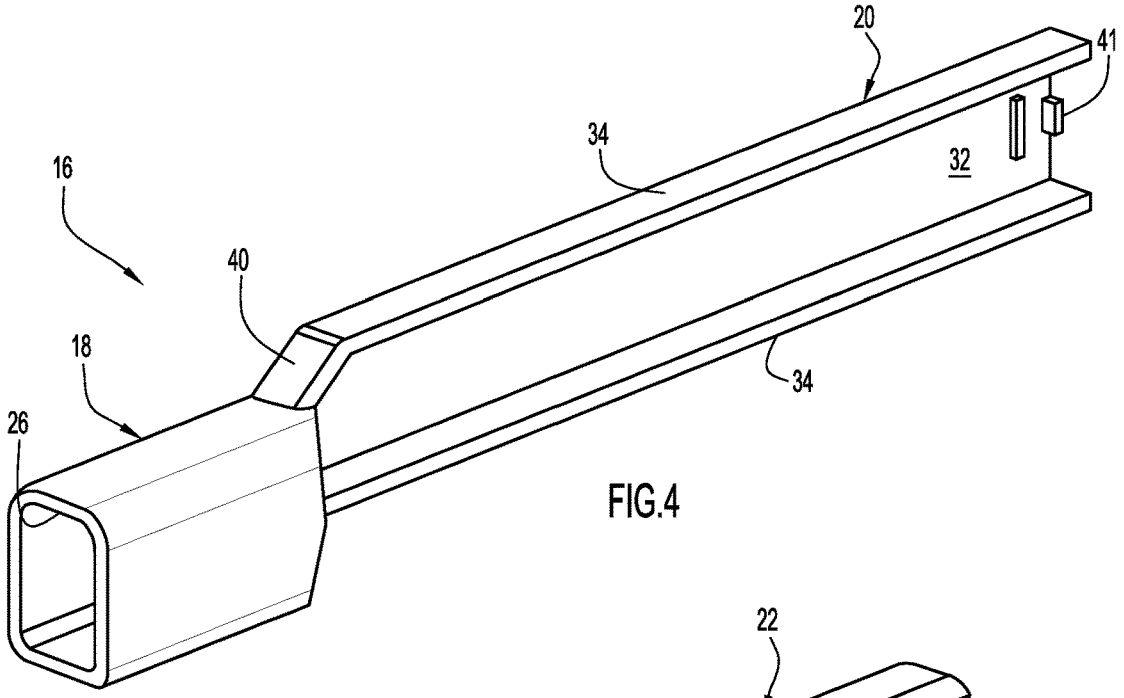
FIG. 4 is a perspective view of a main unit of the apparatus of FIG. 1.

Referring still to FIGS. 1-3, it can be seen that the magazine holder 18 is disposed at one end of the main unit 16 and includes a hollow body defining an opening or cavity 26 configured to hold a pistol magazine 14. For example, magazine holder 18 may have a tubular configuration of generally rectangular configuration defining an opening 26 of generally rectangular configuration as shown in FIG. 4. The opening or cavity 26 may be configured to receive a pistol magazine 14 open end first so that the open end 28 of the magazine is positioned adjacent the tray 20. The opening or cavity 26 may extend through the magazine holder 18 to provide access to the open end 28 of the pistol magazine 14 from the tray 20. The magazine holder 18 may include one or more locking features, such as a releasable detent mechanism, to securely hold the pistol magazine 14 within the holder during loading operations. For example, the pistol magazine may engage a locking feature when it is inserted into the magazine holder and be removable by operation of a magazine release similar to those found on a handgun.

The pistol magazine 14 may include a first central or long axis 30, and the tray 20 may include an elongate bottom wall 32 with laterally opposed side walls 34 defining an elongate channel with a second central or long axis 36 laterally offset from the first long axis 30. In an example embodiment, the amount of lateral offset between the first and second long axes may be equal to the length of the tapered metal flanges or lips at the opening of the magazine ±5 mm. The length and width of the elongate channel may be selected to hold a desired number of cartridges of a specific caliber side-by-side in a column as shown. For example, the channel width may be equal to the length of a cartridge ±7 mm. In an embodiment, the bottom wall 32 may include a plurality of spaced cartridge-shaped indentations (see, e.g., FIG. 3 at 38) to facilitate arranging the cartridges into a column for loading into a pistol magazine. The indentations 38 may be numbered to facilitate matching the number of cartridges to the capacity of the pistol magazine or to otherwise load a desired number of cartridges. The tray 20 further includes an angled wall 40 extending across the elongate channel toward the opening 26 at a non-zero angle $\alpha$ relative to the second long axis 36. In an embodiment, the non-zero angle $\alpha$ may be about 45°, where by "about" is meant ±10°. The tray 20 may also include a stop 41 at an upstream end of the channel to prevent the sleeve 22 and handle 24 from being separated from the main unit 16. For example, the stop 41 may be beveled to allow the sleeve 22 and the handle 24 to be inserted onto the main unit 16 while preventing the sleeve and the handle from moving in an opposite direction past the stop.

The tray 20 and the magazine holder 18 may be coupled with each other in a variety of ways. For example, the magazine holder 18 and the tray 20 may be formed as separate pieces and connected together (e.g., using fasteners, adhesives, or thermal welding), or they may be formed as an integral one piece unit (e.g., by molding). The main unit 16 may be formed of any material rigid enough to maintain an adequate offset between the cartridges and the magazine and durable enough to withstand loading operations. In an example embodiment, the main unit 16 is formed of a plastic material. Optionally, metal or some other highly durable material may be used to reinforce points susceptible to wear and tear (e.g., due to exposure to high pressures and/or repeated contact forces), such as the bottom and/or side walls of the tray.

Figure 5:
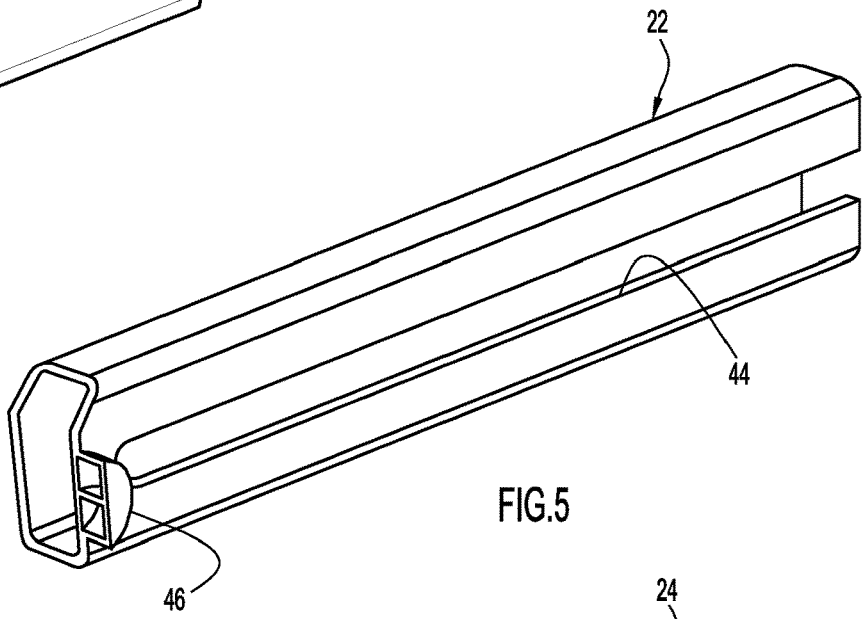
FIG. 5 is a perspective view of a sleeve of the apparatus of FIG. 1.

The sleeve 22 may include at least one wall 42 covering the tray 20, the at least one wall having a longitudinal slot 44 formed therein in parallel with the second long axis 36. The wall 42 may include a protrusion 46 at an end closest to the magazine holder 18. In an embodiment, the protrusion 46 may be semicircular. In an embodiment, the sleeve 22 may include a tubular body of generally rectangular cross-section configured to fit telescopically over the tray 20 to help retain the cartridges in the tray during loading operations, e.g., as shown in FIG. 5 at 22. In an embodiment, sleeve 22 may be formed of a transparent or translucent material to allow visualization of the cartridges within the tray.

Figure 6:
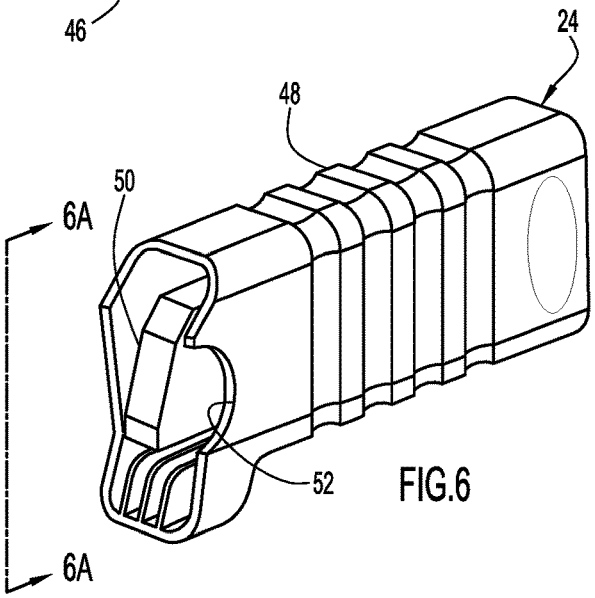
FIG. 6 is a perspective view of a handle of the apparatus of FIG. 1.
Figure 6A:
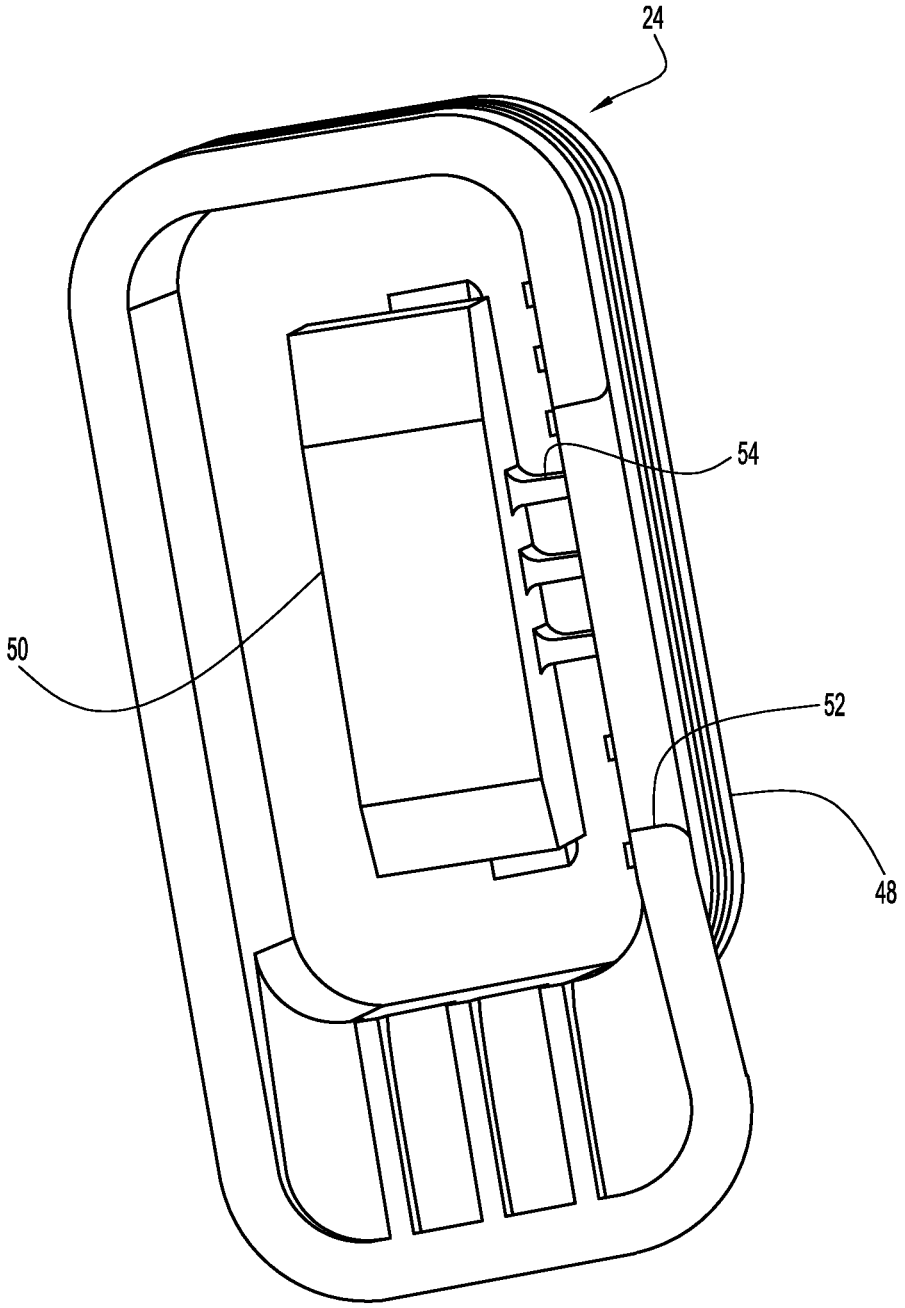
FIG. 6A is an end view of the handle of FIG. 6, taken through line 6A-6A.

The handle 24 includes a grip 48 disposed outside the sleeve 22, a pusher 50 disposed inside the tray 20, and a connecting member (see FIG. 6A at 54) slidably disposed in the longitudinal slot 44 and coupling the grip with the pusher. Handle 24 may also include a recess 52 aligned with the protrusion 46 so that when the handle is moved to the end of the sleeve 22, the protrusion is received in the recess and acts as a stop to prevent further movement of the handle beyond the end of the sleeve that might cause premature wear or damage to the apparatus. In an embodiment, grip 48 may include a tubular body of generally rectangular cross-section configured to fit telescopically over the sleeve 22, e.g., as shown in FIG. 6 at 48. Pusher 50 may be disposed at least partly within grip 48 and may protrude longitudinally therefrom as shown. FIG. 6A shows an example embodiment in which the pusher 50 is connected to the grip 48 by a connecting member 54 configured to slide within the longitudinal slot 44 in sleeve 22 while being strong enough to withstand loading operations. For example, the connecting member 54 may include a tab with a plurality of reinforcing ribs as shown. The handle 24 may be formed of any material rigid enough to maintain a specified angle and durable enough to withstand loading operations. In an embodiment, handle 24 may be formed of a plastic material.

Figure 7:
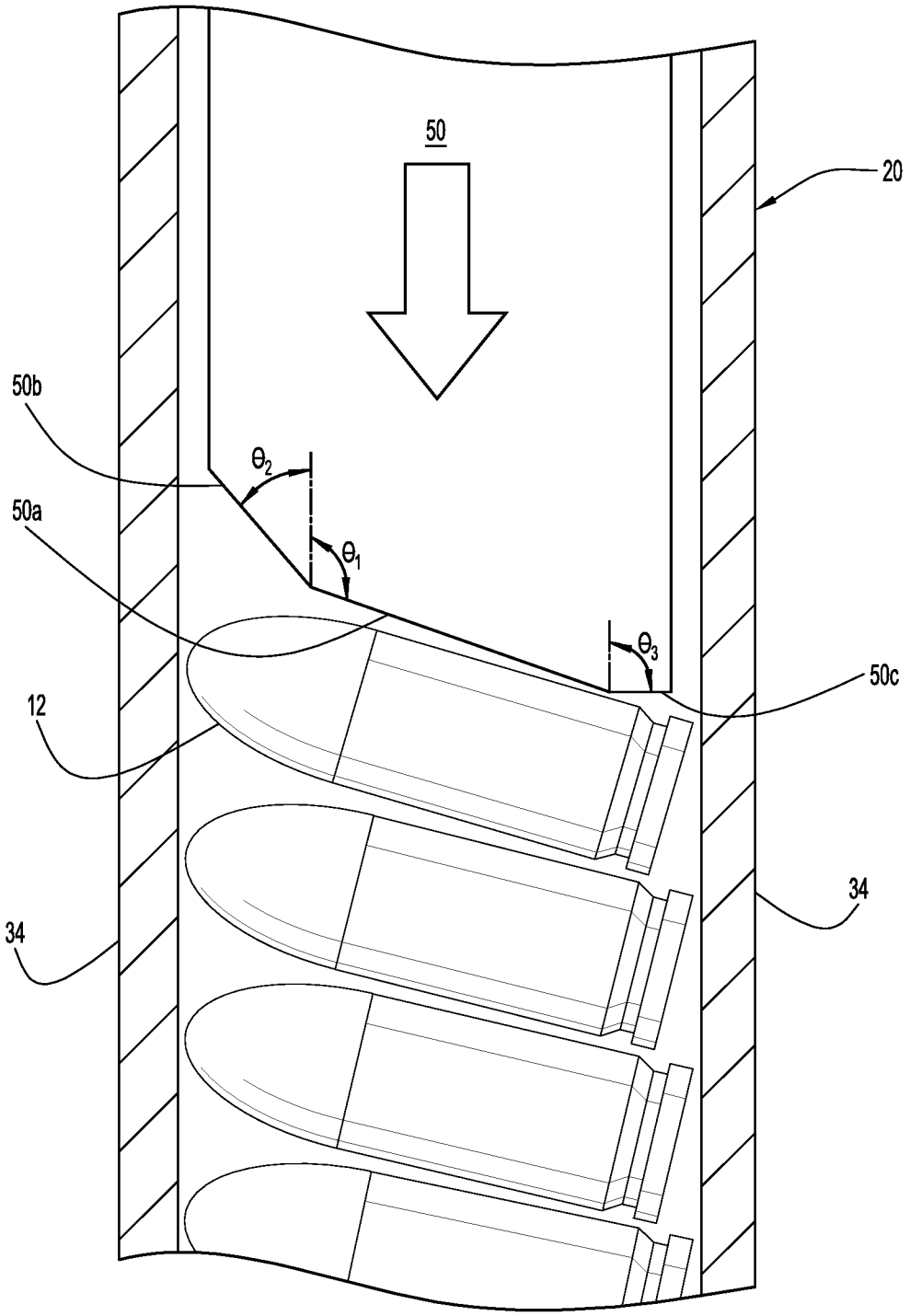
FIG. 7 is a partial side view of the apparatus of FIG. 1 showing details of a pusher according to an example embodiment of the present invention.

Referring now to FIG. 7, it can be seen that pusher 50 may include an angled pusher surface 50*a* oriented at an oblique angle $\theta_1$ relative to the second long axis 36 to induce a tilt in the cartridges 12 that is conducive to loading a pistol magazine. For example, angling the pusher surface may cause constriction at the tip of the lowermost cartridge in the tray that is interacting with the angled wall at the end of the channel, while at the same time causing downward pressure to be applied to the butt end of the cartridge casing, which may force the cartridges in the channel and the magazine down, to make room for the cartridge entering the magazine. In an example embodiment, angle $\theta_1$ may be 110°±15° when measured in a clockwise direction from the second long axis to the surface as shown (or 70°±15° when measured in a counterclockwise direction from the second long axis to the surface). The leading edge 50*b* of the pusher 50 adjacent a tip of the uppermost cartridge 12 may also be oriented at an angle $\theta_2$ relative to the second long axis 36 to prevent contact between the pusher and the angled wall 40 before all of the cartridges are fully loaded. For example, $\theta_2$ may be equal to a (e.g., 45°±10°). Furthermore, a trailing edge 50*c* of the pusher 50 adjacent a butt end of the uppermost cartridge may be oriented at an angle $\theta_3$ relative to the second long axis 36 to permit some rocking motion as the cartridges are loaded. For example, $\theta_3$ may be equal to 90°±35°.

In use, the open end 28 of an empty or less than fully loaded pistol magazine 14 with a first long axis 30 is inserted into the opening 26 in magazine holder 18 and advanced until the open end of the magazine is adjacent the opening between the magazine holder and the tray (or until a retaining mechanism, such as a detent mechanism, is engaged). A plurality of cartridges 12 are positioned in the elongate channel defined by the tray 20 such that the cartridges are stacked side-by-side to form a column along the second long axis 36 that is laterally offset from the first long axis 30. If the sleeve 22 is covering the tray 20, the sleeve may be retracted or removed to deposit the cartridges into the tray 20.

The sleeve 22 is then advanced over the tray 20, e.g., until the lowermost end of the sleeve abuts the magazine holder 18, so that all of the cartridges 12 in the tray are covered and will not pop out during loading operations. The handle 24 may positioned on the sleeve 22 by aligning the connecting member 54 with the longitudinal slot 44 in the sleeve and advancing the grip 48 longitudinally until the handle is in a first position in which the pusher 50 abuts the uppermost cartridge 12 in the tray 20.

The cartridges 12 in the tray 20 may be loaded into the pistol magazine 14 simply by moving the handle 24 in the direction of the magazine (e.g., downwardly in FIGS. 1 and 2) to cause the pusher 50 to move longitudinally along the slot 44 in the sleeve 22 until all of the cartridges are loaded, e.g., until recess 52 on the handle abuts the protrusion 46 on the sleeve. More specifically, moving the handle 24 along the longitudinal slot 44 in the direction of the pistol magazine 14 causes the pusher 50 to urge the plurality of cartridges 12 toward the angled wall 40 at the end of the elongate channel adjacent the magazine. Pressure exerted by the angled surface 50*a* of the pusher 50 on the uppermost cartridge is transferred to the lowermost cartridge through the column of cartridges and, together with the interaction between the lowermost cartridge and the angled wall 40 at the end of the tray 20, creates a constriction that causes the butt end of the lowermost cartridge to tilt downwardly and slide under the lips 56 of the pistol magazine 14, thereby loading the round. Moving the handle 24 downwardly is continued to cause each of the cartridges in succession to be tilted by the angled wall 40 and loaded into the pistol magazine 14 along the first long axis 30.

Figure 8A:
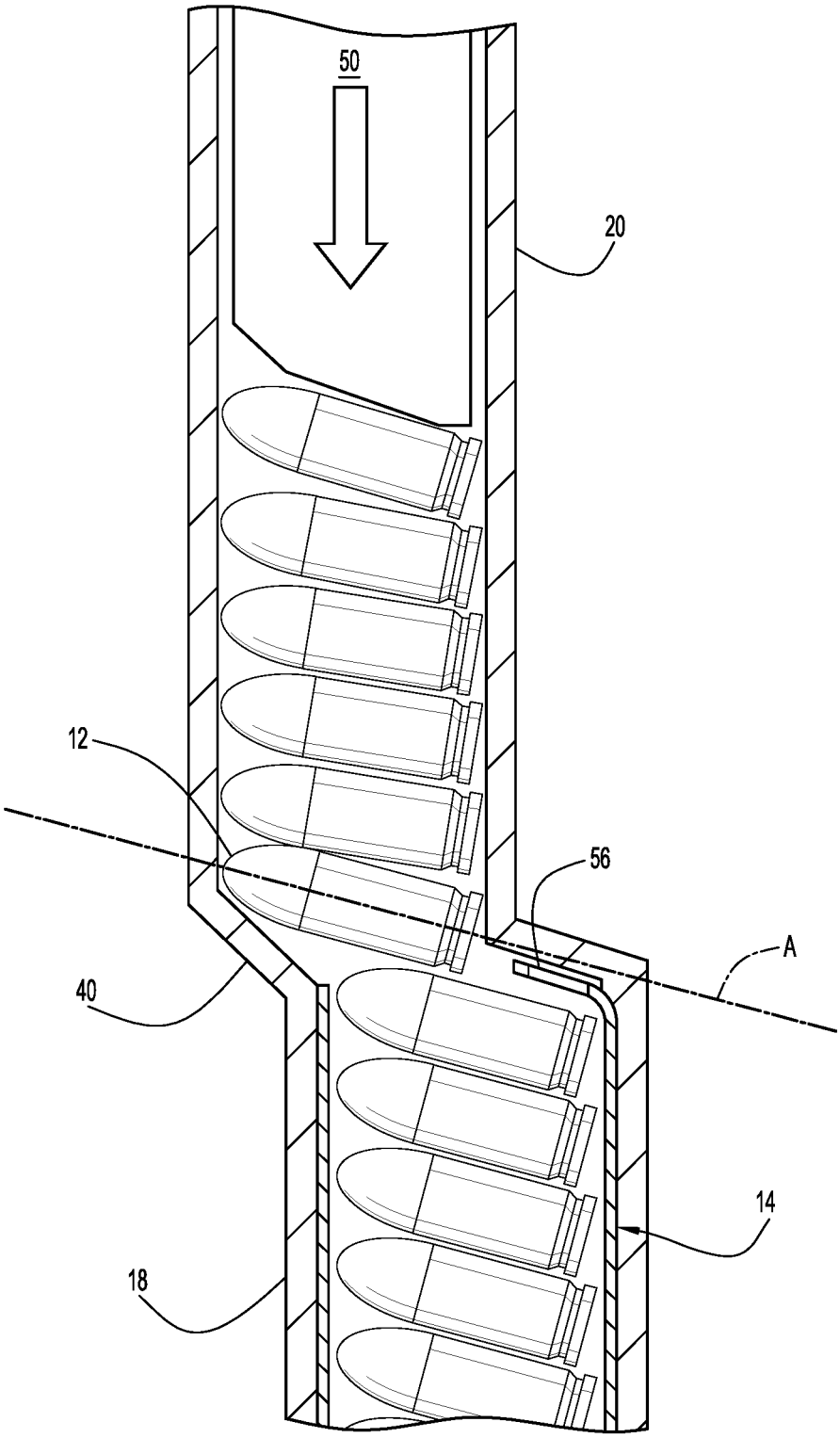
FIGS. 8A-8F are partial sectional side views of the apparatus of FIG. 1 showing the apparatus in use.
Figure 8B:
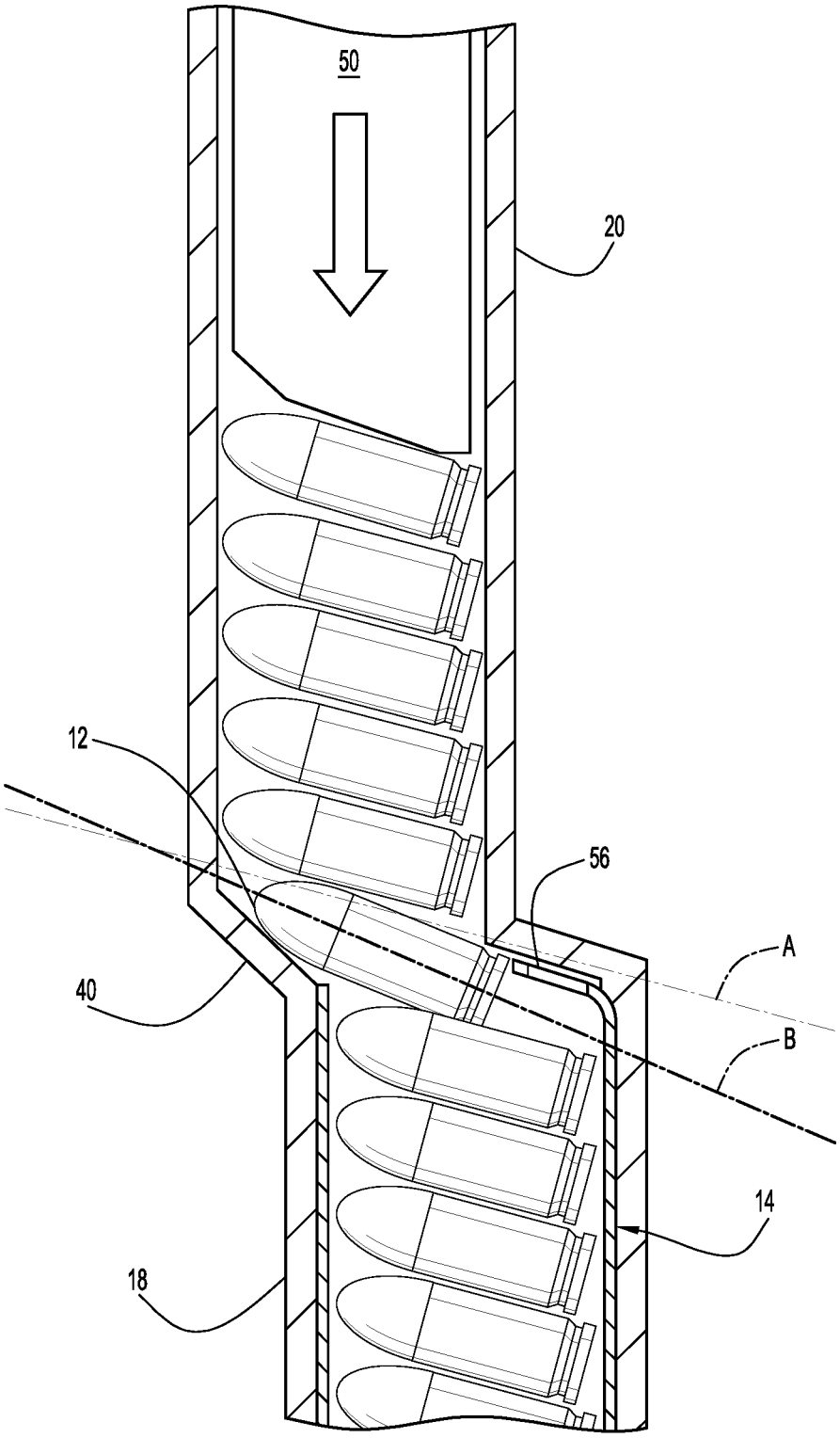
Figure 8C:
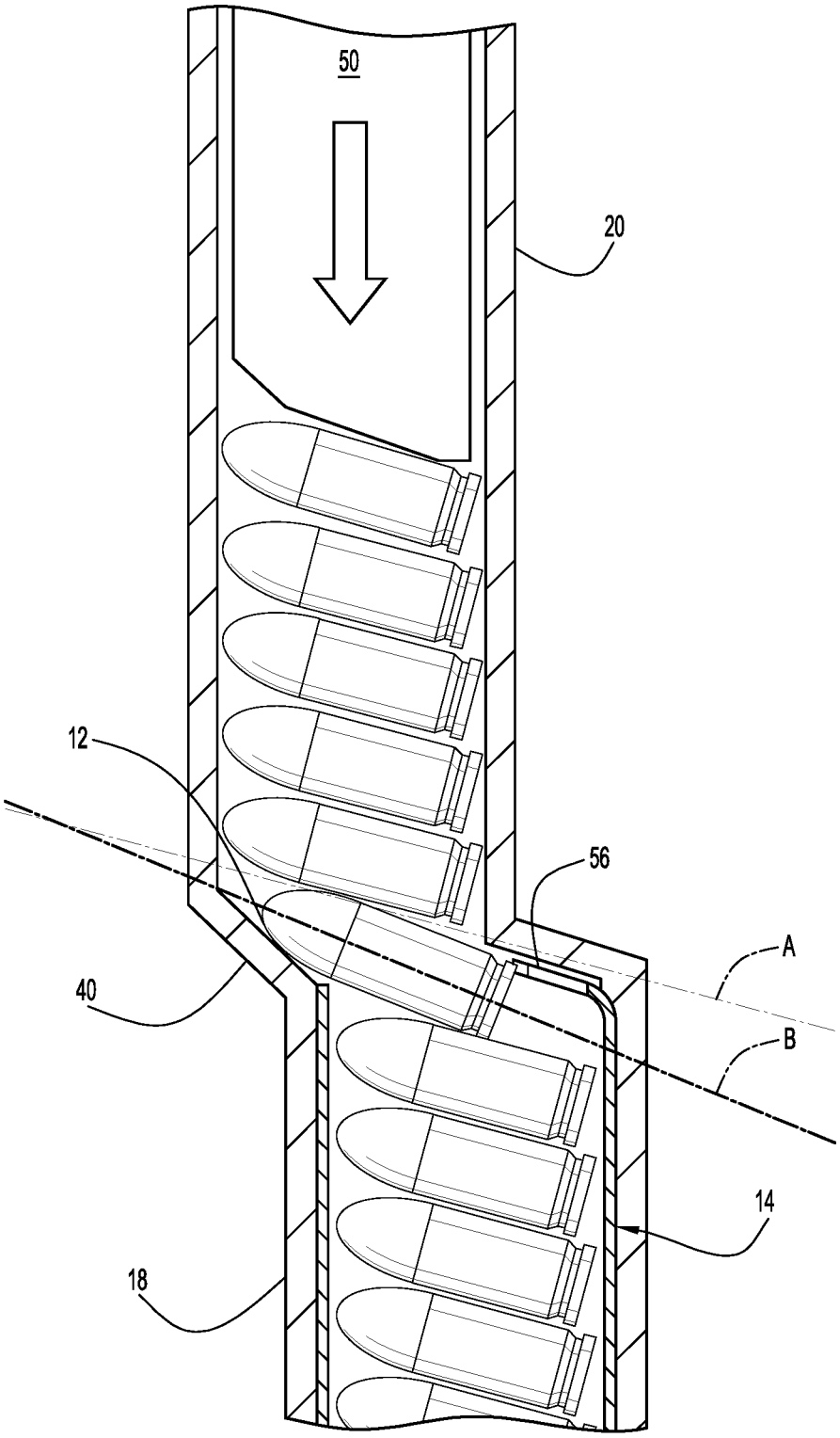
Figure 8D:
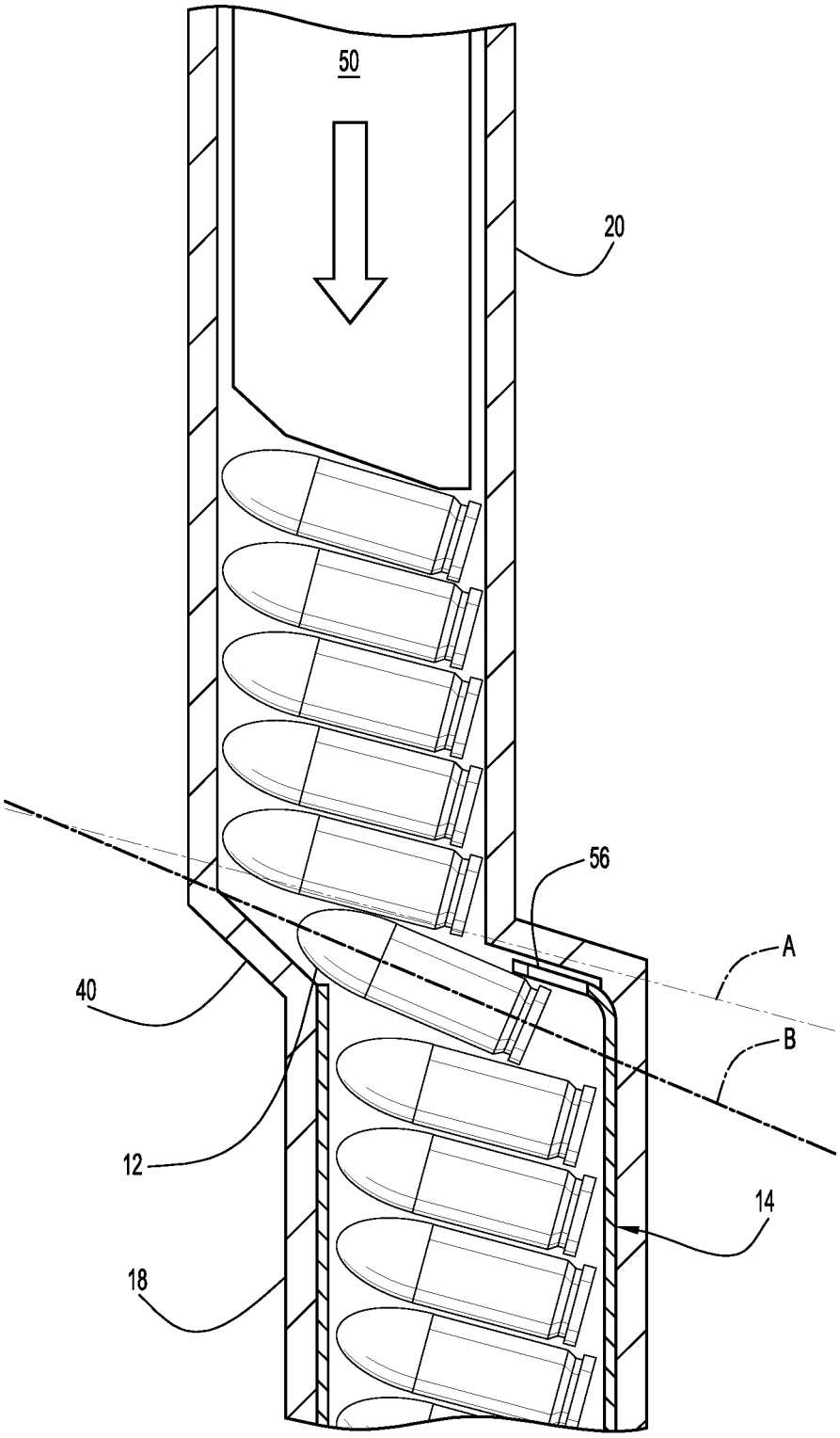
Figure 8E:
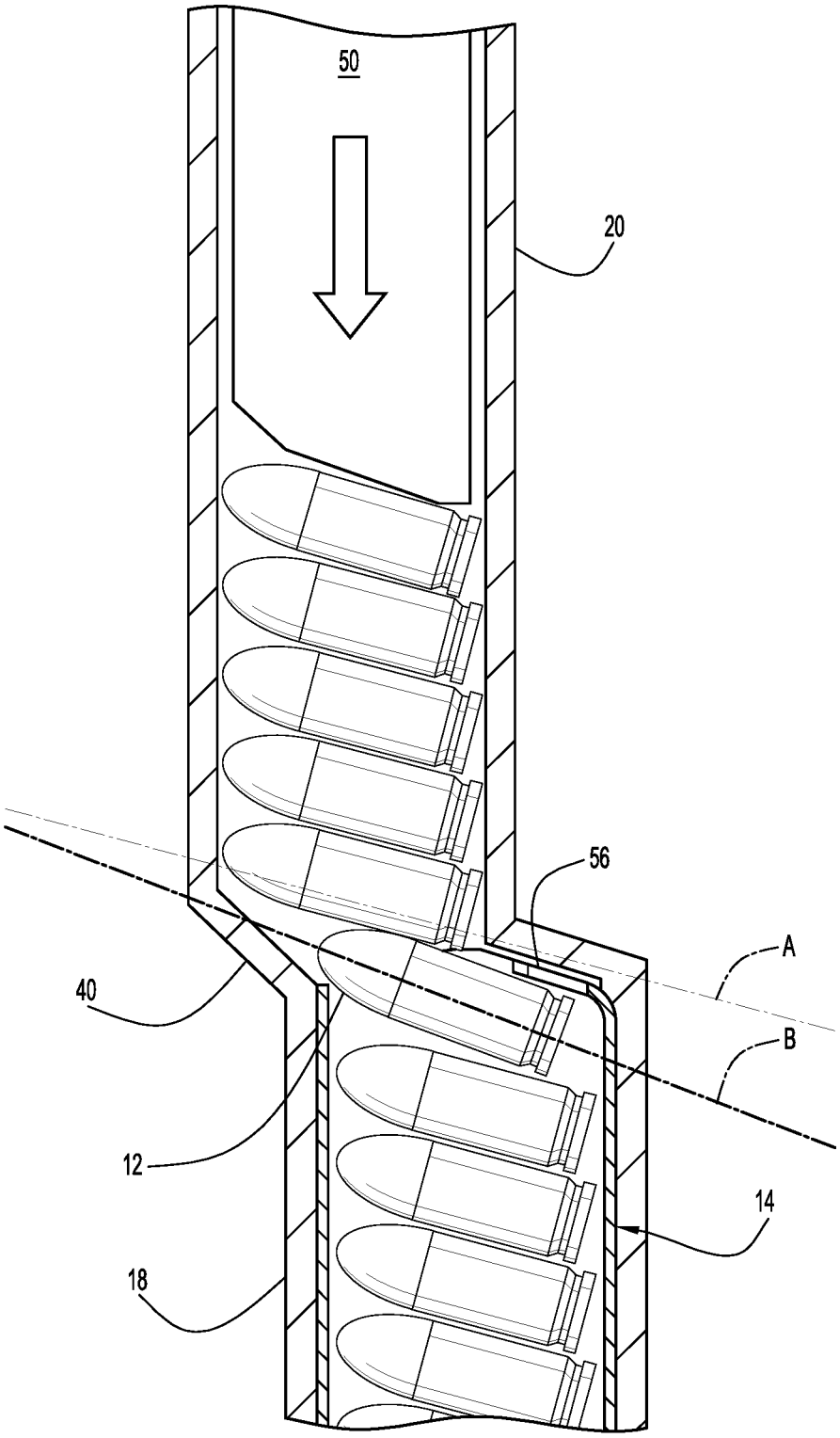
Figure 8F:
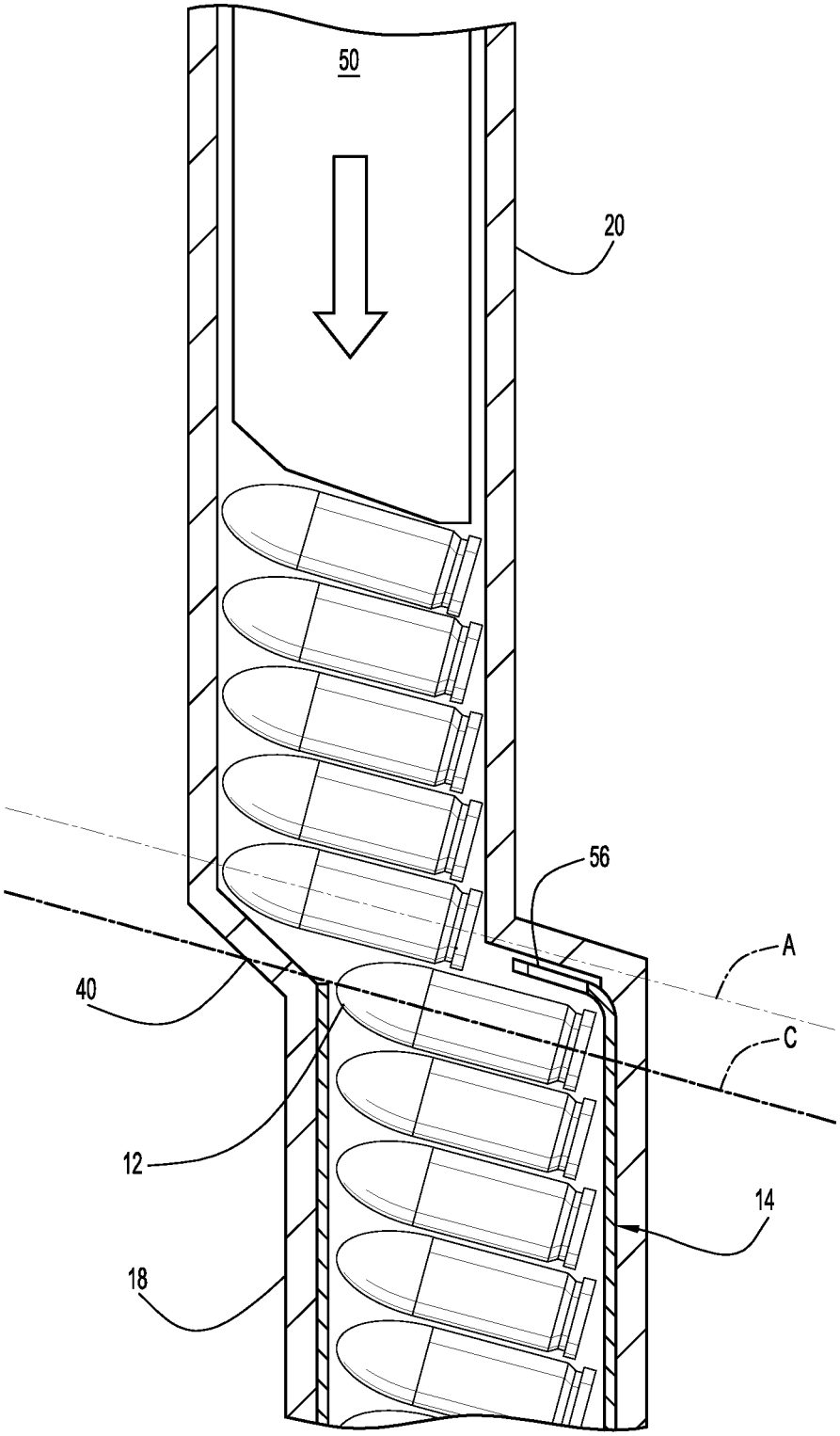

FIGS. 8A-8F are partial sectional side views of the apparatus 10 showing an example of how a cartridge 12 at the lower end of the tray 20 is initially oriented along an axis A (FIG. 8A) and, as a result of pressure exerted by pusher 50 and interaction of the cartridge with angled wall 40, is tilted to an orientation along an axis B (FIG. 8B). Continued downward movement of the pusher 50 and interaction with the angled wall 40 causes the cartridge to slide laterally backward along the axis B (FIG. 8C) until the cartridge casing slides under the lips 56 of the magazine (FIGS. 8D & 8E). When the tip of the cartridge 12 clears the angled wall 40 and is seated within the magazine 14, it assumes an orientation along an axis C generally parallel to its initial orientation but longitudinally and laterally displaced therefrom relative to the second long axis of the tray (FIG. 8F).

Figure 9A:
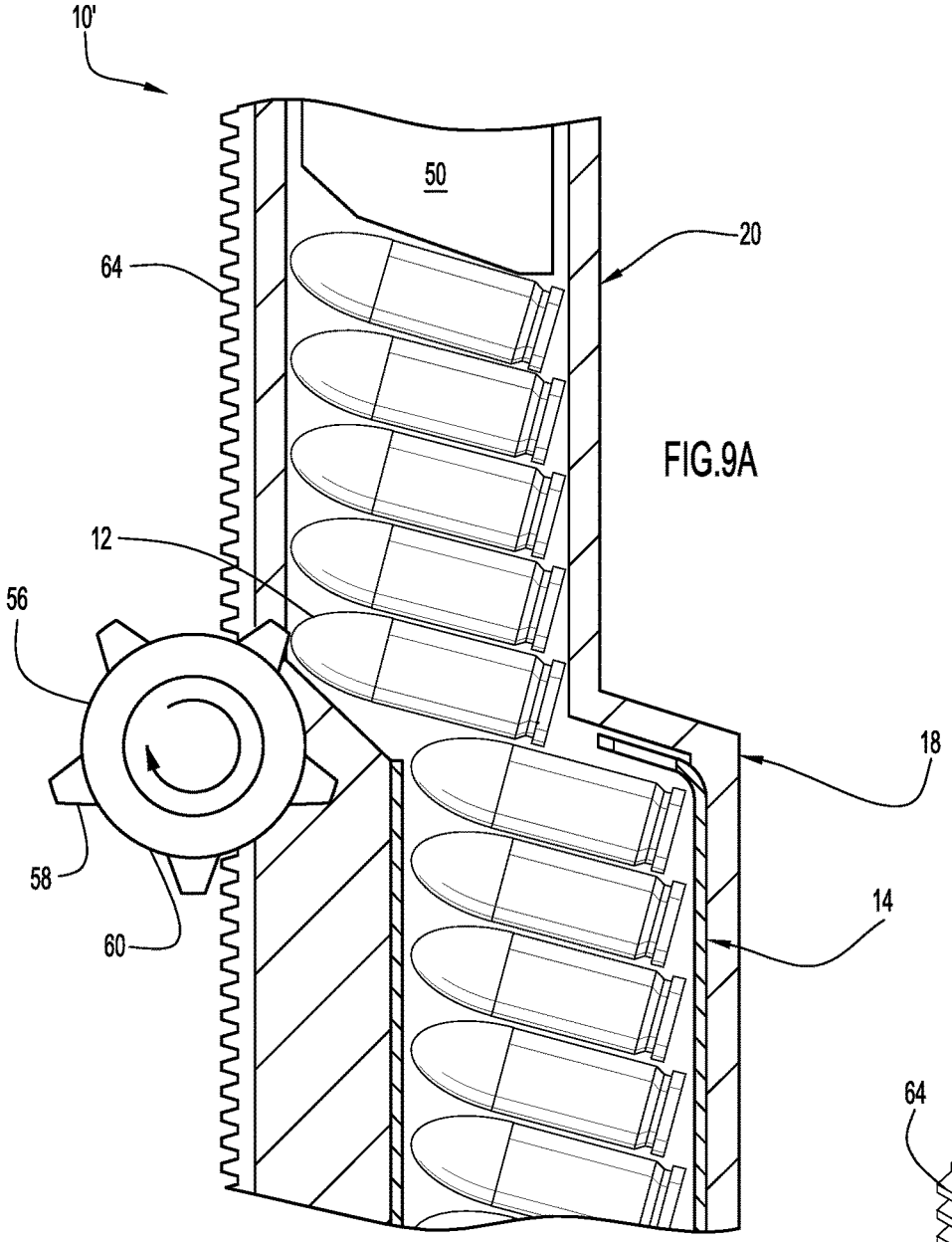
FIG. 9A is a partial side view of an apparatus for loading a pistol magazine according to another example embodiment of the present invention.
Figure 9B:
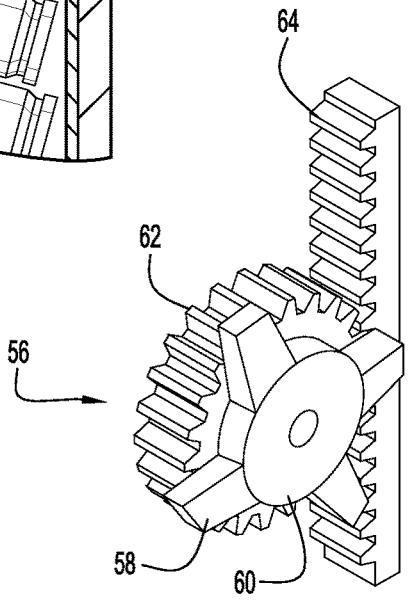
FIG. 9B is a partial perspective view of the apparatus of FIG. 9A.

FIGS. 9A and 9B show another example embodiment of an apparatus 10' for loading a pistol magazine according to the present invention. The apparatus 10' is similar to the apparatus 10 shown in FIGS. 1-3, except a wheel 60 with pusher nubs 58 is provided to push cartridges one at a time from the tray into the pistol magazine. Pusher nubs 58 extend radially outward from the wheel 60 at angularly spaced intervals about the circumference of the wheel. The wheel 60 is mounted on a gear 62 which is mounted for rotation on main unit 16 between the tray 20 and magazine holder 18. Gear 62 engages a gear rail or rack 64 that can slide up and down relative to tray 20. In an embodiment, the rail or rack 64 may slide in its own channel in the tray 20 alongside the channel for the cartridges 12. The rail or rack 64 is coupled with the handle so that, when the handle is moved downwardly towards the pistol magazine, the rail moves downwardly with the handle and causes the gear 62 to rotate in the direction of the pistol magazine 14, thereby causing the wheel 60 to also rotate in the direction of the pistol magazine. As the wheel 60 rotates, a nub 58 engages a tip of the lowermost cartridge 12 in the tray 20 and pushes the cartridge downwardly and laterally backwardly under the lip 56 at the open end of the magazine 14. The gear ratio between the rail 64 and the gear 62 may be selected to synchronize the rate of rotation of the wheel to match the speed of downward travel of the cartridges.

Figure 10:
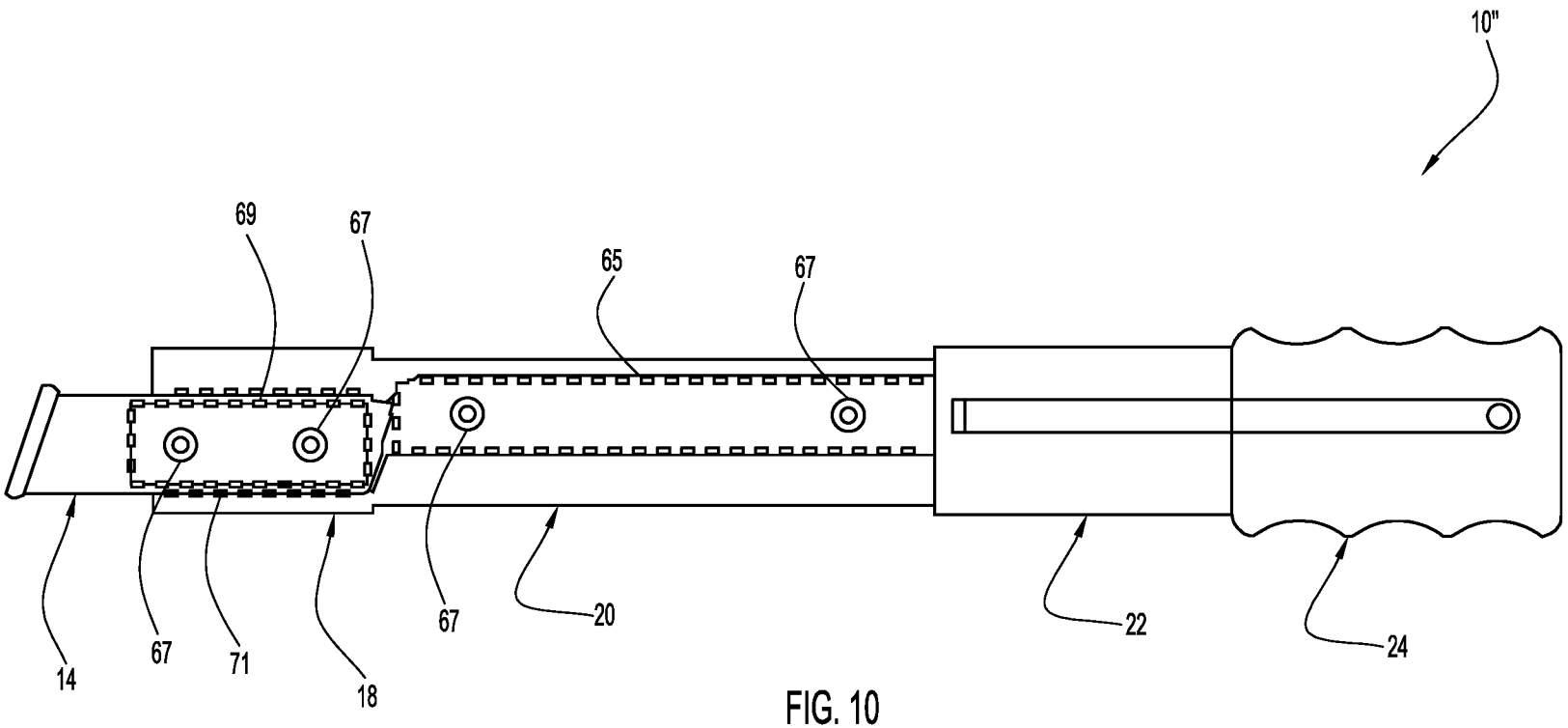
FIG. 10 is a side view of an apparatus for loading a pistol magazine according to yet another example embodiment of the present invention.

FIG. 10 shows a further example embodiment of an apparatus 10" for loading a pistol magazine according to the present invention. The apparatus 10" is similar to the apparatus 10 shown in FIGS. 1-3, except the main unit is configured to receive adapter inserts 65, 69, and/or 71 in order to accommodate cartridges and pistol magazines of different shapes and sizes. Adapter insert 65 may be configured to be removably positioned in tray 20, to reduce a size of the channel. For example, adapter insert 65 may comprise a liner that fits against the bottom and side walls. Similarly, adapter insert 71 may be configured to be removably positioned in the opening 26 in magazine holder 18 to reduce a size of the opening to accommodate smaller and/or differently shaped magazines. Adapter insert 69 may be fastened to sides of a smaller pistol magazine 14 to increase its size so that it may fit within the opening 26 in magazine holder 18. The adapter inserts 65, 69, and/or 71 may be configured to be held in place using threaded fasteners 67 as shown, a friction fit, hook and loop fasteners, or any other suitable fastening technique.

Figure 11:
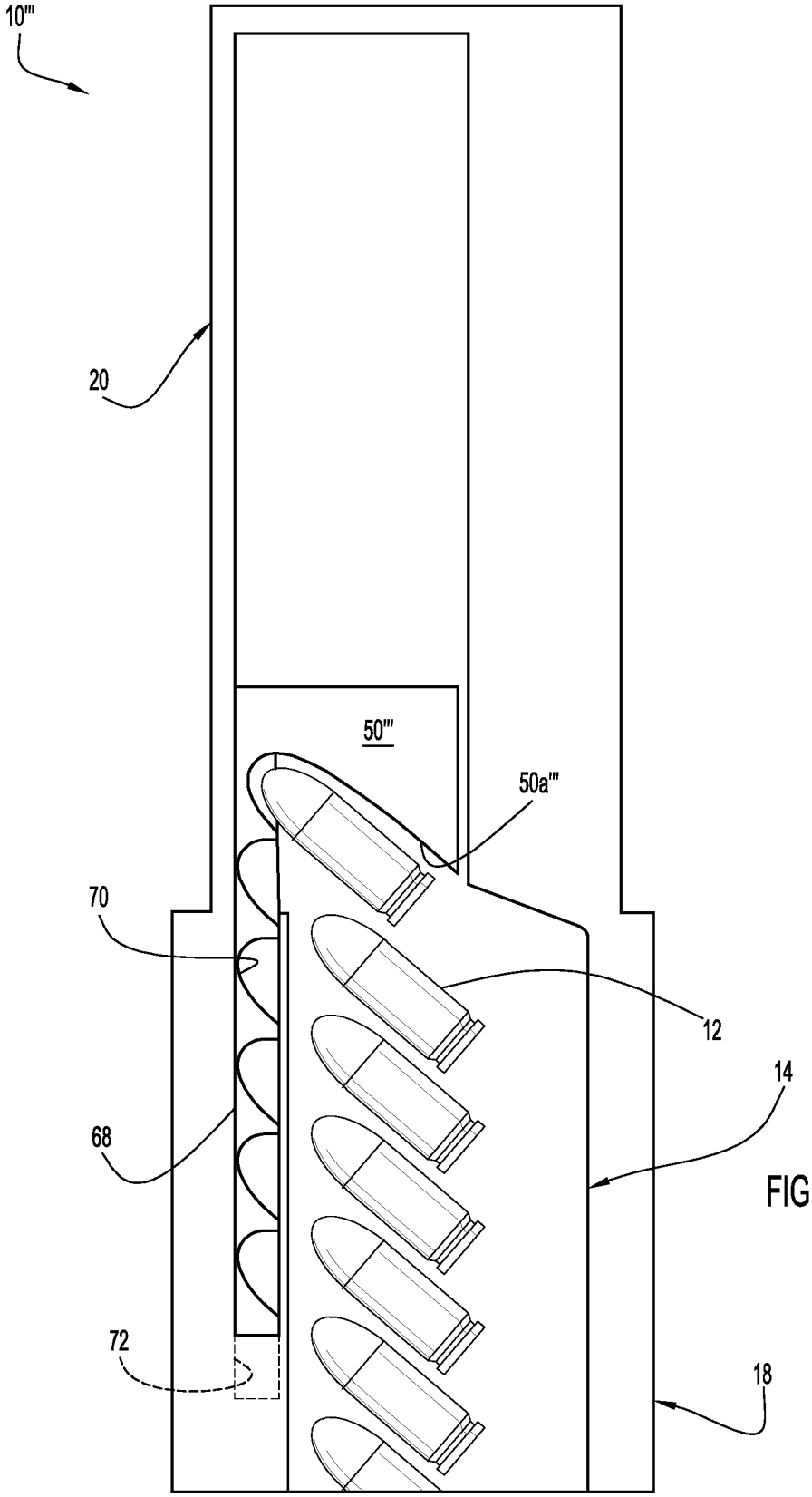
FIG. 11 is a partial side view of an apparatus for loading a pistol magazine according to still another example embodiment of the present invention.

FIG. 11 shows yet another example embodiment of an apparatus 10' for loading a pistol magazine according to the present invention. The apparatus 10''' is similar to the apparatus 10 shown in FIGS. 1-3, except that the pusher 50' includes an elongate finger 68 that protrudes from the angled surface 50*a*''' across tips of the cartridges 12, and the angled wall 40 of the main unit includes an opening or groove 72 configured to receive the finger as the handle is moved towards the pistol magazine 14. In an example embodiment, the finger 68 may include a series of bullet shaped indents 70 configured to engage tips of the bullets. In use, as the handle is moved towards the pistol magazine, the angled surface 50*a*''' of the pusher urges the column of cartridges 12 towards the pistol magazine 14, and the finger 68 slides into the opening or groove 72 in the angled wall 40 of the tray 20. The cartridge closest to the pistol magazine is stripped from the finger by the angled wall and fed into the magazine.

From the above, it will be appreciated that an apparatus according to an example embodiment of the present invention may produce a pushing force that is transmitted through the column of cartridges which may be constrained to a straight path. The angle of the pusher may also be telegraphed across the column of cartridges ensuring that each consecutive cartridge has the angle needed to make contact at the necessary points and times on both the angled wall and the shell casing of the last round that entered the magazine. The combination of the pressure and angle of the pusher and the angle of the angled wall may cause a constriction on the front part of the first bullet in the tray, forcing the first bullet in the tray to move backward, down, and then backward some more, into the magazine, under the lips of the magazine, and on top of the last bullet to enter the magazine.

While example embodiments of the present invention have been shown and described, it will be appreciated that various modifications and changes may be made without departing from the spirit and scope of the invention. For example, self-adjusting channels may be provided to allow the apparatus to be used with cartridges and magazines of different sizes without the need for removable adapter inserts. Examples of self-adjusting channels include channels comprising spring loaded walls or compressible walls or walls lined with a compressible material, such as cork. Also, providing a convex radius or curvature on the angled surface of the pusher may smooth the loading process by allowing the cartridges to rock as each cartridge traverses from the tray into the magazine. Furthermore, while a tray is shown having cartridge indentations oriented perpendicular to the long axis of the tray, it will be appreciated that cartridge indentations may be formed at an oblique angle relative to the long axis of the tray. For example, the cartridge indentations may be formed at the same angle as the pusher surface. While a handle with a tubular grip configured to fit telescopically around the sleeve is shown, it will be appreciated that other types of handles may be used. For example, the handle may include a rod or plunger arranged longitudinally in the elongate channel, with one end of the plunger protruding outwardly from the tray to be gripped by a user and the other end of the plunger terminating at a pusher. In one embodiment, the plunger may have a width about the same as the elongate channel and a length longer than the elongate channel so that a portion of the plunger extends outwardly from the channel a sufficient amount to be gripped by hand. Additionally, while the pusher is shown and described as being moved by hand as part of a handle, it will be appreciated that the pusher may be moved in other ways, such as by use of a motor or actuator instead of, or in addition to, a handle. For example, a motor may be used to rotate the wheel shown in FIGS. 9A & 9B, causing the pusher to move in the elongate channel via a connection with the rack or rail. These and other modifications and changes are intended to be within the scope of the invention.

The invention claimed is:

1. An apparatus for loading cartridges into a pistol magazine, the apparatus comprising:

a main unit comprising a magazine holder and a cartridge holder coupled with the magazine holder, the magazine holder defining an opening configured to receive a pistol magazine along a first axis, and the cartridge holder defining a channel configured to hold a plurality of cartridges in a column along a second axis that is different than the first axis, the cartridge holder further including an angled wall at an end of the channel proximate the magazine holder, the angled wall being oriented at a non-zero angle relative to the second axis; and a handle including a pusher configured to extend into the channel along the second axis, the pusher including a pusher surface oriented at an oblique angle relative to the second axis, and the handle being movable relative to the main unit to cause the pusher to force cartridges in the channel against the angled wall and into the pistol magazine.

2. The apparatus of claim 1, wherein the first axis is laterally offset from the second axis.

3. The apparatus of claim 1, wherein the angled wall is oriented at an angle of about 45° relative to the second axis.

4. The apparatus of claim 1, wherein the pusher surface is oriented at an angle of about 70° relative to the first axis.

5. The apparatus of claim 1, wherein the pusher surface intersects the second axis.

6. The apparatus of claim 1, wherein the pusher includes a trailing edge on a side of the pusher surface corresponding to a butt of a cartridge to be loaded, the trailing edge being oriented substantially perpendicular to the second axis.

7. The apparatus of claim 1, wherein the pusher includes a leading edge on a side of the pusher surface corresponding to a tip of a cartridge to be loaded, the leading edge being oriented parallel to the angled wall.

8. The apparatus of claim 1, further comprising a member that rotates at an end of the cartridge holder proximate the magazine holder.

9. The apparatus of claim 8, wherein the member that rotates is disposed proximate the angled wall.

10. The apparatus of claim 9, wherein the member that rotates is positioned to engage a cartridge to be loaded.

11. The apparatus of claim 9, wherein the member that rotates protrudes into the channel from the angled wall.

12. The apparatus of claim 8, wherein the member that rotates is configured to rotate as cartridges are forced towards the magazine holder by the pusher.

13. The apparatus of claim 12, wherein the member that rotates is configured to rotate about an axis of rotation perpendicular to the second axis.

14. The apparatus of claim 13, wherein the member that rotates includes a circular portion concentric with the axis of rotation.

15. The apparatus of claim 1, wherein the opening in the magazine holder is defined by self-adjusting channels.

16. The apparatus of claim 15, wherein the self-adjusting channels are selected from at least one of the group comprising spring-loaded walls, compressible walls, and walls lined with a compressible material.

17. The apparatus of claim 1, further comprising an adapter insert configured to be removably positioned in the opening in the magazine holder.

18. The apparatus of claim 1, further comprising an adapter insert configured to be removably positioned in the channel in the cartridge holder.

19. The apparatus of claim 1, further comprising an adapter insert configured to be fastened to sides of a pistol magazine so that the pistol magazine may fit within the opening in the magazine holder.

* * * * *